US005551682A

United States Patent [19]

Lüthi

[11] Patent Number: 5,551,682

[45] Date of Patent: Sep. 3, 1996

[54] METHOD OF SUPPLYING ENCLOSURES TO MULTIPLE-PAGE PRINTED SHEETS COLLECTED TO FORM PRINTED PRODUCTS

[75] Inventor: Ernst Lüthi, Brittnau, Switzerland

[73] Assignee: Grapha-Holding AG, Hergiswil, Switzerland

[21] Appl. No.: 361,335

[22] Filed: Dec. 21, 1994

[30] Foreign Application Priority Data

Dec. 21, 1993 [CH] Switzerland ..... 03801/93

[51] Int. Cl.[6] ..... B65H 5/30

[52] U.S. Cl. ..... 270/52.18; 270/52.3

[58] Field of Search ..... 270/53, 54, 55, 270/57

[56] References Cited

U.S. PATENT DOCUMENTS

| | | | |
|---|---|---|---|
| 3,527,455 | 9/1970 | Reist | 270/55 |
| 3,926,423 | 12/1975 | Merker et al. | 270/55 |
| 4,200,275 | 4/1980 | Wangermann . | |
| 4,729,554 | 3/1988 | Honegger | 270/55 |
| 5,067,699 | 11/1991 | Gadway et al. | 270/55 |
| 5,137,409 | 8/1992 | Honegger | 270/55 X |
| 5,165,672 | 11/1992 | Backman | 270/55 |
| 5,292,111 | 8/1994 | Hansch | 270/54 |
| 5,354,043 | 10/1994 | Reist | 270/54 |
| 5,417,410 | 5/1995 | Meier | 270/53 |

FOREIGN PATENT DOCUMENTS

| | | |
|---|---|---|
| 0210494 | 2/1987 | European Pat. Off. . |
| 399317 | 11/1990 | European Pat. Off. . |
| 546326 | 6/1993 | European Pat. Off. . |
| 3616566 | 12/1986 | Germany . |

*Primary Examiner*—John E. Ryznic
*Attorney, Agent, or Firm*—Spencer & Frank

[57] ABSTRACT

A method and apparatus for supplying at least one enclosure to multiple-page printed sheets collected to form printed products at the edge opposite the last folded edges. The printed products are gripped at the fold side on collecting carriers and removed from the collecting apparatus. The products are supplied with enclosures on a further conveying path with the open edge facing a feeder.

12 Claims, 2 Drawing Sheets

METHOD OF SUPPLYING ENCLOSURES TO MULTIPLE-PAGE PRINTED SHEETS COLLECTED TO FORM PRINTED PRODUCTS

BACKGROUND OF THE INVENTION

The invention relates to a method and apparatus of supplying enclosures to multiple-page printed sheets collected to form printed products at the edge opposite the last folded edges.

In rotary staplers having a collecting segment configured as collecting carriers for printed sheets, it is known to insert an enclosure between two printed sheets during the collecting process. This takes place in that the next sequential printed sheet is first placed on an auxiliary support above the printed sheet conveyed to the collecting segment ahead of it, and afterwards is further conveyed with the printed sheet(s) lying beneath it. The one part of the upper printed sheet hanging down to the side is lifted by a guide apparatus so that an opening which narrows toward the fold can be created with the lower printed sheet; this opening serves to receive an enclosure, such as a card, pamphlet or the like, which is conveyed perpendicular to the conveying direction.

Such a construction has only limited applications in different rotary staplers, particularly when stringent requirements are placed on production output and differently formatted enclosures are conveyed.

SUMMARY OF THE INVENTION

It is an object of the invention to develop a method of the type mentioned at the outset that has met higher requirements than previously, without the quality of the printed products being impaired.

According to the invention, this object is accomplished in that the printed products gripped at the fold-side on a collecting apparatus and removed from this apparatus are supplied with inserted enclosures on the further conveying path with the opened edge facing a feeder. In this way, changes in direction of the printed products on the processing path can be prevented.

Moreover, a more gentle processing method is selected.

A construction is provided having a plurality of collecting carriers spaced from one another at regular intervals and being arranged to rotate past a transfer location. Each of the collecting carriers are for collecting and conveying a respective printed product to the transfer location. A conveyor apparatus has a movable traction mechanism. A plurality of gripping pliers are secured to the traction mechanism. Each gripping plier is associated with a respective one of the collecting carriers, and is moved past the transfer location to grip the respective printed product at the transfer location and remove the printed product from the respective collecting carrier. Separating means are positionable inside a fold of the printed product gripped by the respective plier for opening the printed product. A feeder is provided for delivering the enclosures along a path of movement to the printed product gripped by the respective plier. The printed products are moved by the pliers along a conveyor path approximately transversely to the path of movement of the enclosures in an opened supplying form for receiving at least one enclosure delivered by the feeder. This assembly has proven to be a particularly advantageous device for supplying printed products produced from a plurality of printed sheets by means of a rotary stapler.

Furthermore, the processing principle according to the invention can also be used as a classic insetting machine for unstapled printed products.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

Figure 1:
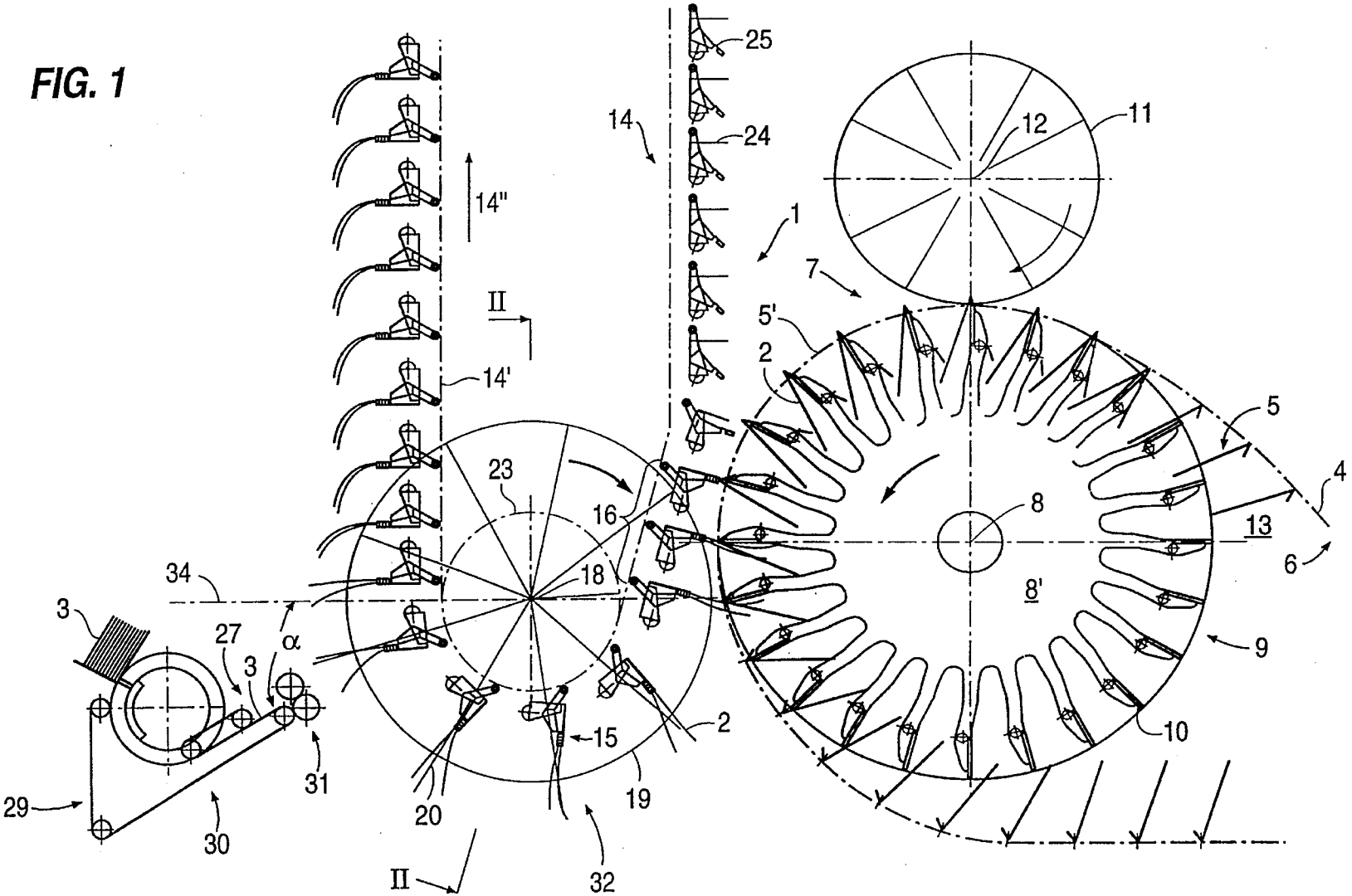
FIG. 1 shows a schematic side view of the device according to the invention.

FIG. 1 illustrates a device 1, which is secured in a stand, for processing printed products, particularly for supplying multiple-page printed sheets collected to form printed products 2 with at least one enclosure 3, which is (are) conveyed to the edge of the printed products 2 opposite the last folded edge(s).

The printed products 2 are collected, astride and stacked one on top of the other, on a collecting segment formed by a plurality of collecting carriers 5 of a rotating conveying element 6, the carriers extending with spacing along a traction mechanism 4 transverse to the conveying direction. Feeders connected in series, not shown, are provided for the differently-printed printed sheets; these feeders are disposed along the upper run or the supplying region of conveying element 6.

Connected to the printed sheet feeders in the illustrated example is a stapling apparatus 7, which is passed by the traction mechanism 4 or conveying element 6 provided with collecting carriers 5. The endless traction mechanism 4 rotates around at least two parallel axes to form a rotating track, of which the one axis 8 is configured to support a stapling wheel 9 of stapling apparatus 7, the wheel having drivable or movable bending elements 10 distributed at its circumference with the spacing of collecting carriers 5 of conveying element 6. The collecting carriers 5 are secured axially symmetrically to a hub 8', which likewise has as its center point axis 8. At least two of these bending elements 10, or the entire folding apparatus on stapling wheel 9, are provided over the support length of a collecting carrier 5, corresponding to the number of staples to be stapled into the fold of a printed product 2. For better understanding, the first three collecting carriers are illustrated without printed sheets on top of them.

In an adaptation to the illustrated situation, stapling apparatus 7 has stapling head pairs 11, which rotate around a parallel axis 12 and, in the vicinity of the rotating track of the collecting carriers 5, form a short, common stapling segment with the carriers.

The stapling segment is, however, not an essential component of the device 1 of the invention, and is described in detail in German Application 36 16 566 or European Application 0 546 326.

In place of the collecting carriers 5 rotating around two axes on a traction mechanism 4, conveying element 6 could also be drum-shaped, as described in DE-A 36 16 566 or EP-A 0 399 317, in which instance collecting carriers 5 extend axially symmetrically along an axis of rotation as so-called collecting segments, and their delivery ends terminate into a stapling apparatus that surrounds the drum-shaped collecting segments in the longitudinal stapling region, or cooperates in "meshing" fashion with the collecting drum as a rotational stapling apparatus.

It must be added that, in the present embodiment, a feed-in segment 13 is provided in front of the stapling segment; bending elements 10 on stapling wheel 9 and their associated collecting carriers 5 engage to form a stable unit on the feed-in segment, i.e., bending elements 10 run into collecting carriers 5 from below.

Stapling apparatus 7 has a plurality of stapling heads 11, which are arranged in star formation and indicated by radial dashes, and are driven so as to rotate around axis 12. Axis 12 extends approximately parallel to axis 8 of stapling wheel 9.

On the further path 51 of collecting carriers 5, after the printed sheets have been stapled to form a printed product 2, the latter, guided by stapling wheel 9, is placed onto a conveyor apparatus 14 comprising gripping pliers 15; a transfer location 16 is formed in their vicinity. Conveyor apparatus includes a traction mechanism 14' movable along a further conveyor path 14".

At this location, gripping pliers 15 of conveyor apparatus 14 grip printed products 2 approximately at the fold and lift them from collecting carrier 5 in that the direction of forward motion of gripping pliers 15 not only moves away from stapling wheel 9 due to the change in direction of stapling wheel 9, but additionally due to a slight bend in the conveyor apparatus 14.

During removal of printed products 2 from collecting carriers 5, the effect of a separating device 17 (FIG. 2) comes into play; this device further maintains the astride state of printed products 2 from collecting carriers 5, or can be used to return printed products 2 to an opened supplying form after exiting collecting carriers 5.

Figure 2:
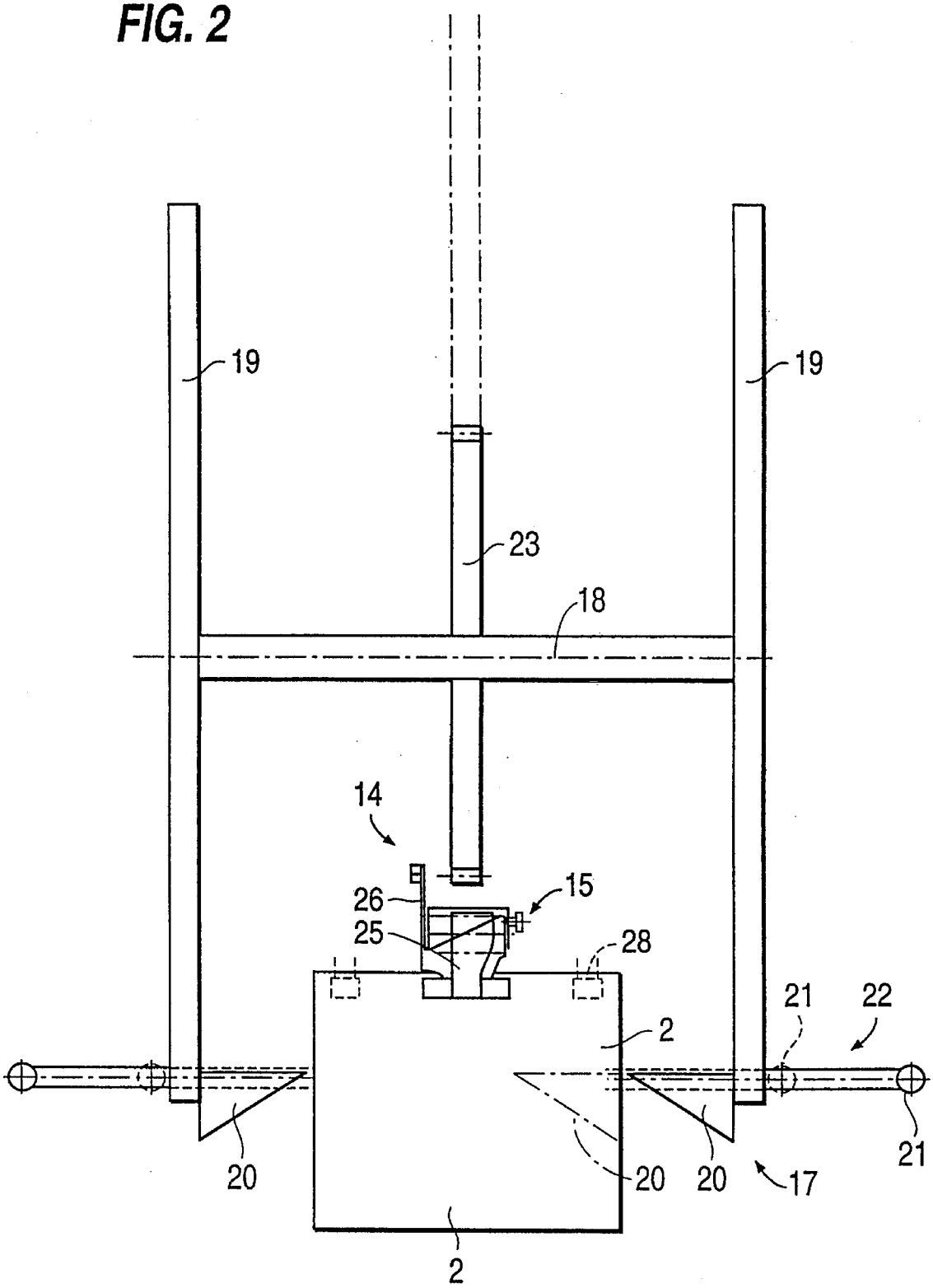
FIG. 2 shows a section through the device of FIG. 1 along line II—II.

One possible embodiment of a separating device 17 is shown in slightly more detail in FIG. 2. Two plates 19 connected by rotating shaft 18 have at their circumference a separating device 17 which is associated with a collecting carrier 5; this apparatus can be driven mechanically, hydraulically, pneumatically or electrically in a direction of deflection perpendicular to the conveying direction. The present separating device 17, which is located beneath the fold of printed products 2 and acts to penetrate them, is a roof-shaped construction 20 tapered in the shape of a wedge with respect to the feed direction. According to the representation, the roof-shaped construction 20 is moved by means of a rod 22 driven by a cam 21, the return stroke of the rod being achieved by, for example, a spring (not shown).

A reverse wheel 23 of conveying apparatus 14, of which one gripper plier 15 is visible, is seated inside between plates 19, but is fixedly attached to them by rotating shaft 18. Gripping plier 15 comprises a rigid clamping jaw 24 and a movable clamping jaw 25; a lever 26 is provided whose movement, among other things, to open gripping pliers 15 with a control apparatus, not shown—e.g. a stationary cam—is actuated prior to the gripping of printed products 2, and to close gripping pliers 15, after the transfer of printed products 2 (FIG. 1).

FIG. 1 also makes apparent that the printed products 2 lifted from collecting carriers 5 can be conducted further in open form, in which case the top portion of the front printed product in the conveying direction is supported by the roof shaped construction 20 Of separating device 17, and the following portion of the printed product can hang down due to gravitation in such a way that a supplying opening is formed between the two parts.

Separating device 17 can be configured such that the separating device 17 located between the side portions of a lifted printed product 2 deflects the corresponding portion of the printed product upwardly by a specially associated driving apparatus (not shown).

To be able to move the enclosure 3 driven by a feeder 29 along the path of movement 27 transversely to the further conveyor path 14, the further conveying path 14 following removal of printed products 2 from stapling wheel 9 by reverse wheel 23 is configured to form an undershot conveyor segment 32. Printed products 2 are opened on this undershot conveyor segment 32 and, at least when they pass the path of movement 27 of enclosures 3, the latter terminates in the opening formed by the astride portions of the printed products, into which opening enclosures 3 are projected, so that they remain inserted in the gap end created by the fold. The path of movement 27, and a horizontal plane 34 extending through the rotating shaft 18 defines an acute angle $\alpha$ in the undershot conveyor segment 32.

To improve the subsequent clamping effect within the fold of a printed product 2 provided for enclosure 3, the clamping force of gripping pliers 15 is to be at least partly released in a controlled manner, at least during the time of supply of the enclosure, by an auxiliary clamping apparatus (indicated by 28) holding printed products 2 approximately in the end regions of the fold. This makes it possible to reduce the closing pressure of gripping pliers 15 directly prior to supply of an enclosure 3, so that the narrower enclosure 3 or enclosures can penetrate further into the fold, by means of which better adherence by the fold can take place. This additional measure proves especially advantageous when a plurality of enclosures 3 is to be supplied to printed product 2.

A feeder 29 known per se is provided for supplying enclosures 3; this feeder first supplies the cards, bags, samples or the like, provided in a stacking hopper, individually to the path of movement 27, where they are transferred by means of projection to printed products 2 by a conveyor 30, which is equipped, for example, at the conveying end with an acceleration apparatus 31.

In order to supply a plurality of enclosures 3, a plurality of feeders 29 can be connected in series or in parallel, along a conveyor apparatus 14 having an extended supply region, i.e., in the first case a plurality of enclosures 3 is conveyed bundled at the end of conveyor 30 to printed products 2 or, in parallel connection of feeders 29, enclosures 3 are supplied sequentially to the opened printed products 2.

It will be understood that the above description of the present invention is susceptible to various modifications, changes and adaptations, and the same are intended to be comprehended within the meaning and range of equivalents of the appended claims.

What is claimed is:

1. A device for supplying enclosures to printed products produced from a plurality of printed sheets, comprising:

a plurality of collecting carriers spaced from one another at regular intervals and being arranged to rotate past a transfer location, each for collecting and conveying a respective printed product to the transfer location;

a conveyor apparatus having a movable traction mechanism; and a plurality of gripping pliers secured to the traction mechanism, each gripping plier being associated with a respective one of said collecting carriers, and being moved past the transfer location to grip the respective printed product at the transfer location and remove the printed product from the respective collecting carrier;

separating means positionable inside a fold of the printed product gripped by the respective plier for opening the printed product; and a feeder for delivering the enclosures along a path of movement to the printed product gripped by the respective plier; whereby the printed products are moved by the pliers along a conveyor path approximately transversely to the path of movement of the enclosures in an opened supplying form for receiving at least one enclosure delivered by the feeder.

2. The device defined in claim 1, further comprising a rotating shaft about which said movable traction mechanism is guided; wherein the conveyor path includes an undershot conveying segment formed by the guiding of the traction mechanism about said rotating shaft, and passing through the path of movement of the enclosures.

3. The device defined in claim 2, further comprising a hub having said collecting carriers axially symmetrically secured thereon, said collecting carriers comprising a staple-bending apparatus; said separating means being driven in a conveying direction about the rotating shaft and being positionable within the fold of the printed product from opposite sides thereof; said gripping pliers being moved approximately tangentially past the rotating collecting carriers in a region of the transfer location.

4. The device defined in claim 3, wherein said conveyor apparatus includes a reversing wheel rotatable about the rotating shaft, and having the traction mechanism guided thereon; said separating means being rotatingly driven coaxially to the rotating shaft.

5. The device defined in claim 4, wherein said separating means is removed from the fold of the printed product after passing the path of movement of the enclosures.

6. The device defined in claim 5, wherein said feeder includes an acceleration apparatus for moving the enclosures along the path of movement.

7. The device defined in claim 6, wherein the path of movement of the enclosures, and a horizontal plane extending through the rotating shaft, form an acute angle in a region of the undershot conveying segment.

8. The device defined in claim 2, wherein a distance between the pliers and the rotating collecting carriers increases after the pliers are moved past the transfer location.

9. The device defined in claim 2, wherein the traction mechanism extends approximately vertically following the undershot conveying segment.

10. The device defined in claim 2, further comprising an auxiliary clamping apparatus for clamping the sides of the printed product along a folded edge thereof and during movement of the printed product through the undershot conveying segment, said auxiliary clamping apparatus cooperating with the respective gripping plier.

11. A device for supplying enclosures to printed products produced from a plurality of printed sheets, comprising:

a stapling apparatus for stapling the printed sheets together to form a respective printed product;

a plurality of collecting carriers spaced from one another at regular intervals and being arranged to rotate past a transfer location, each for collecting the printed sheets and conveying the printed sheets to the stapling apparatus, and conveying the resulting printed product to the transfer location;

a conveyor apparatus having a movable traction mechanism; and a plurality of gripping pliers secured to the traction mechanism, each gripping plier being associated with a respective one of said collecting carriers, and being moved past the transfer location to grip the respective printed product at the transfer location and remove the printed product from the respective collecting carrier;

separating means positionable inside a fold of the printed product gripped by the respective plier for opening the printed product; and a feeder for delivering the enclosures along a path of movement to the printed product gripped by the respective plier; whereby the printed products are moved by the pliers along a conveyor path approximately transversely to the path of movement of the enclosures in an opened supplying form for receiving at least one enclosure delivered by the feeder.

12. The device defined in claim 11, further comprising a driving apparatus for opening the printed products, and cooperating with said separating means.

* * * * *